United States Patent [19]

Sahar

[11] Patent Number: 4,807,646

[45] Date of Patent: Feb. 28, 1989

[54] DEVICE FOR USE BY SMOKERS TO ENABLE SMOKING IN PUBLIC PLACES

[76] Inventor: Raphael Sahar, 2 Rehov David Hamelech, Tiberias, Israel

[21] Appl. No.: 70,581

[22] Filed: Jul. 7, 1987

[51] Int. Cl.[4] ..... A24F 7/00; A24F 13/00; A24F 13/16

[52] U.S. Cl. ..... 131/177; 131/329; 131/330; 131/227; 131/229

[58] Field of Search ..... 131/175, 329, 330, 174, 131/327, 229

[56] References Cited

U.S. PATENT DOCUMENTS

| | | | |
|---|---|---|---|
| 3,918,464 | 11/1975 | Kolodziej | 131/175 |
| 4,172,460 | 10/1979 | Robertson | 131/175 |
| 4,198,992 | 4/1980 | Smith | 131/175 |
| 4,216,786 | 8/1980 | Wright | 131/330 |
| 4,369,798 | 1/1983 | Jackson | 131/330 |

*Primary Examiner*—V. Millin

*Attorney, Agent, or Firm*—Fleit, Jacobson, Cohn & Price

[57] ABSTRACT

A device is provided for the use of smokers, safeguarding non smokers in the same room against inconvenience and harmful effects of smoke. The device includes a bladder or like vessel into which the smoke emitted from the mouth of the smoker is blown.

3 Claims, 3 Drawing Sheets

DEVICE FOR USE BY SMOKERS TO ENABLE SMOKING IN PUBLIC PLACES

FIELD OF THE INVENTION

The present invention relates to a device for use by smokers and more specifically to a device which safeguards against the harmful effects of cigarettes or cigar smoke persons in the same room as are one or more who indulge in smoking.

BACKGROUND OF THE INVENTION

Members of the medical profession—both practitioners, as well as research scientists—seem to be unequivocally of the opnion that cigarette and cigar smoking is harmful, not only to those actively smoking, but also to "passive smokers", i.e. those who are present in rooms (this term including also railway compartments and autobuses) in which people smoke.

The present invention provides a device safeguarding passive smokers against the harmful effects of ciagarette or cigar smoke.

SHORT SUMMARY OF DISCLOSURE

The new device comprises an openable container in which a short sleeve serving as a cigarette or cigar holder is positioned, an elongated mouthpiece including a first and a second conduit leading from the said container, the said first conduit being in communication with said short sleeve serving as cigarette or cigar holder while the second conduit leads into the open, non-return valves—preferably of sphincter type—being positioned in both said conduits, the said valves permitting flow in opposite directions of one another only.

SHORT DESCRIPTION OF DRAWINGS

These, and further features of the invention will now be described in detail with the aid of the annexed drawings wherein:

FIG. 1 is a sectional, and

FIG. 2 an exterior view of the new device, while

FIG. 3 is a plan view, partly in section.

DETAILED DESCRIPTION OF PREFERRED EMBODIMENT

Figure 1:
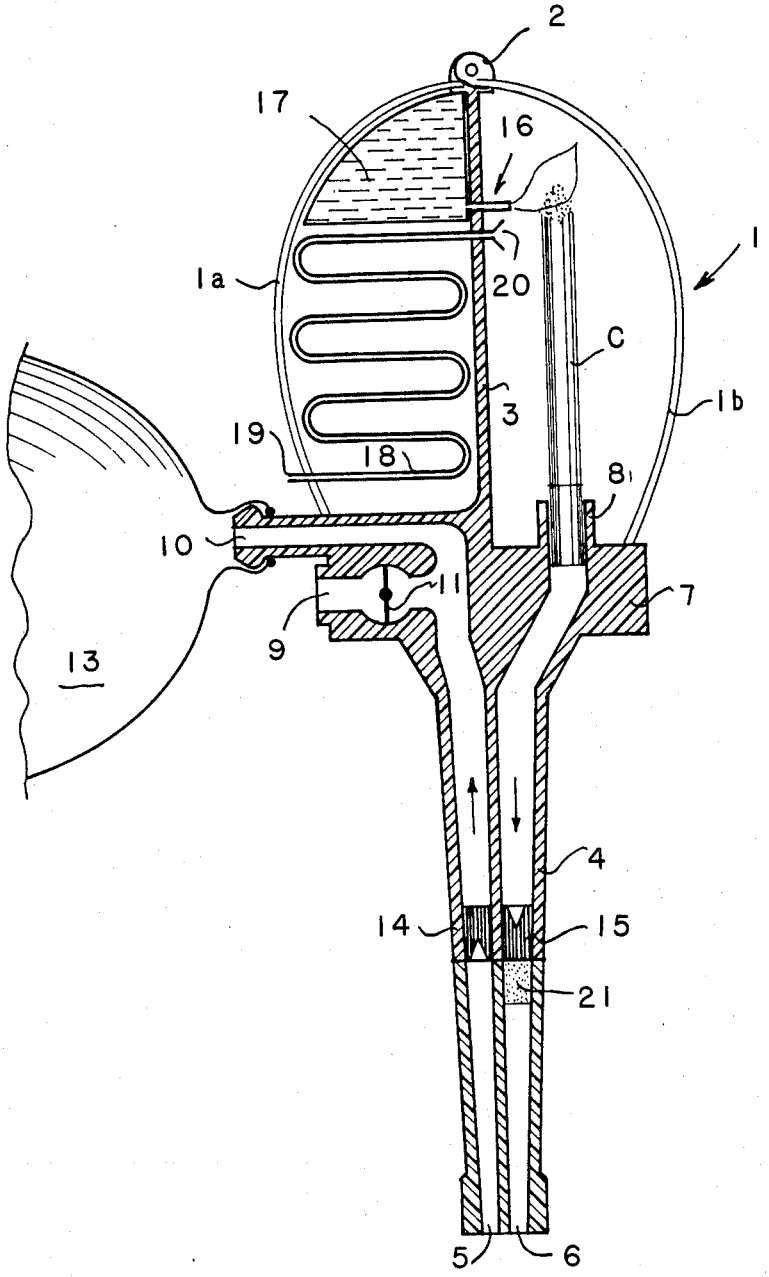
Figure 2:
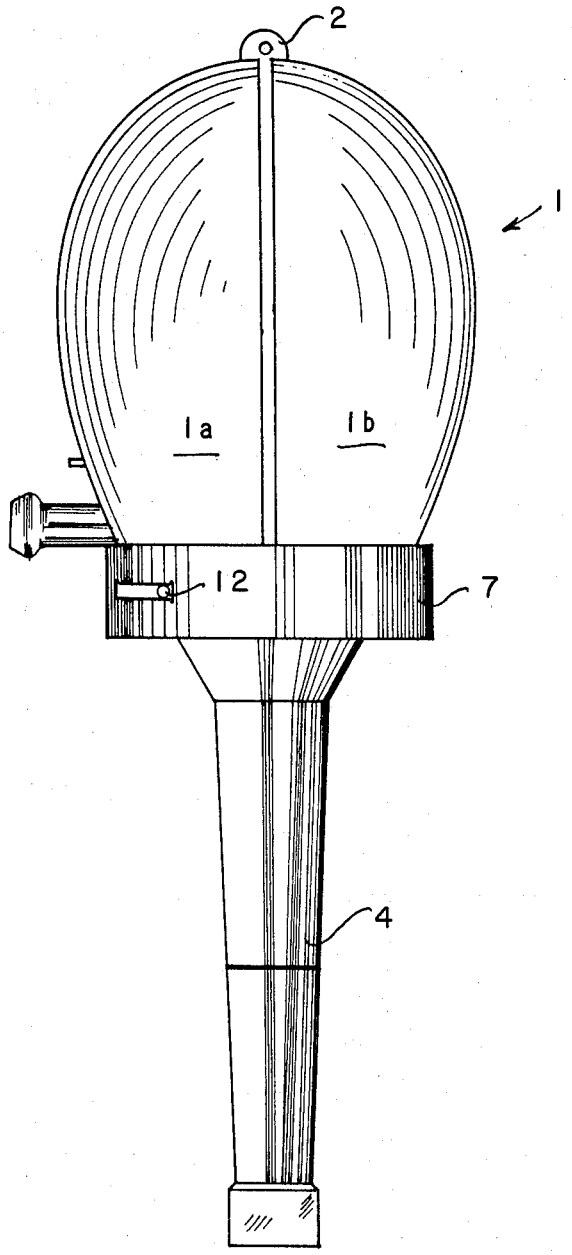
Figure 3:
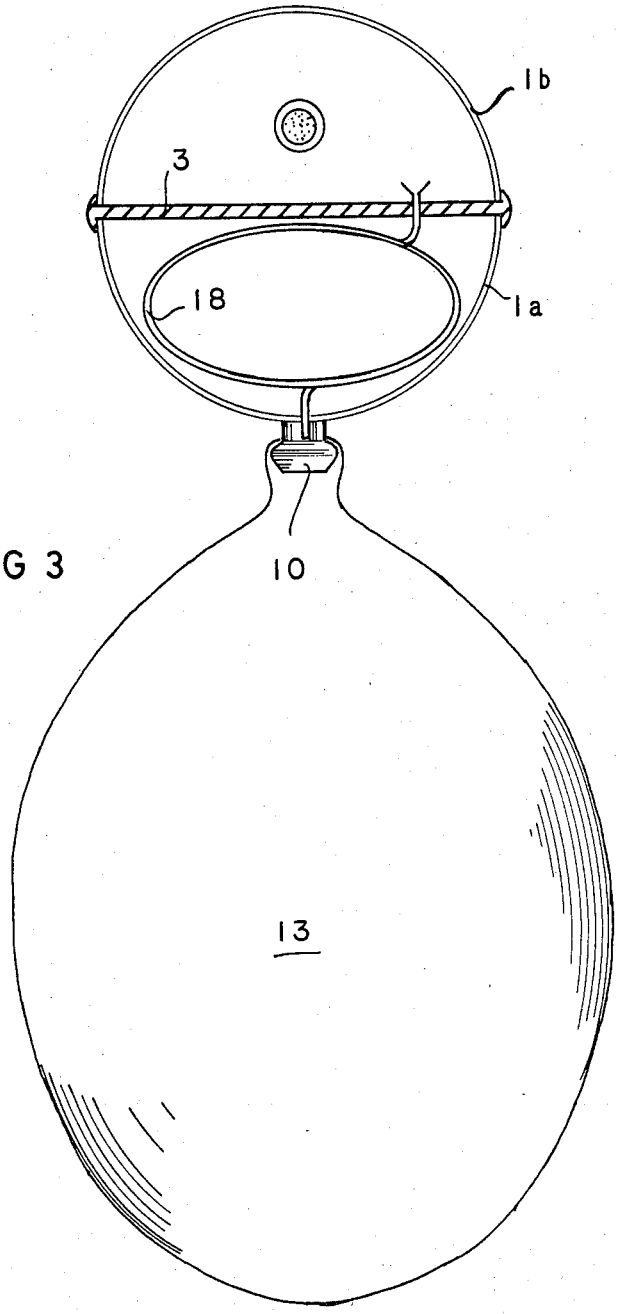

The device comprises a container 1 which consists of two halves indicated by numerals 1*a* and 1*b*. The two halves are hingedly connected to one another at 2. Within the container 1 extends a partition 3 which is fixed to part 1*a*. From one small end of container 1 (which is of substantially ovoidal shape) extends an elongated mouthpiece 4 in which are provided two substantially parallel conduits 5 and 6 both of which are open to the atmosphere at the free end of the mouthpiece 4. The ovoidal container 1 is seated (and part 1*a* being affixed thereto) on a disc shaped base 7 through which both conduits 5 and 6 are led, as will be described. From base 7 rises within container 1 a short sleeve 8 which serves as a holder for a cigarette C. The sleeve 8 is in communication with conduit 6. Conduit 5 passes through base 7 and there are branched off from it two outlets 9 and 10. Outlet 9 leads into the open, but can be sealed by a flap 11 which is openable at will from the exterior by a knob 12. Outlet 10 leads into a bladder (or like vessel) 13. Within the two conduits 5 and 6 are placed non-return valves (such as of the sphincter type) 14 and 15 which permit flow of a medium in one direction only, as indicated by arrows, i.e. opposedly to one another.

So far, the absolutely necessary parts of the new device have been described. Preferably there may be provided also a cigarette lighter 16, including a fuel container 17. Further, there may be provided a serpentine shaped narrow pipe conduit 18 one end of which—at 19—extends into the open while the other end, within container 1 faces the supposed place of the tip of a cigarette C placed in holder 8. A filter 21 may be provided in conduit 6.

The use of the new device by a smoker is as follows: Container 1 is opened by swinging its half 1*b* about hinge 2. Now the cigarette is lighted (either by a match or by lighter 16 if there is such included in the device). The container 1 is then closed.

The smoker inserts the free end of mouthpiece 4 into her or his mouth whereupon smoke is drawn into the smoker's mouth in the same way as in the case with a conventional cigarette holder. Smoke is then expelled from the smoker's mouth—no matter whether it had been inhaled or not—and has to pass through conduit 5 and branch 10 into the bladder 13, where it is retained.

It will be seen that in this way a smoker would not incommodate others—"passive smokers"—in the same room. If no others are present, or in the open, flap 11 may be opened, thereupon smoke will escape through outlet 9.

Obviously, when a smoker draws smoke through conduit 6, a slight subpressure is created in the interior of half part 1*b* which causes some air to enter through serpentine pipe 18, thereby preventing the cigarette from extinguishing by admitting the necessary oxygen to allow combustion of the tobacco.

I claim:

1. A device for safeguarding non smokers against harmful effects of smoke emitted by cigarette or cigar smokers which device comprises an openable container in which a short sleeve serving as a cigarette or cigar holder is positioned, an elongated mouthpiece including a first and a second conduit leading from the said container, the said first conduit being in communication with said short sleeve serving as cigarette or cigar holder while the second conduit leads into a sealed compartment, non-return valves being positioned in both said conduits, a first of the non-return valves being located in the first conduit for permitting flow of smoke from a cigarette or cigar on said holder into a smokers mouth when a smoker sucks on the mouthpiece, and a second of the non-return valves being located in the second conduit for permitting the smoker to expel smoke through the seconduit into said sealed compartment.

2. The device of claim 1, characterised thereby that it further comprises a cigarette lighter within said container.

3. The device of claim 1, characterized by the provision of a, serpentine shaped pipe positioned within the said container and leading into the open at one end of the pipe, the second end being open to the interior of the container near said holder.

* * * * *